US008638227B2

(12) United States Patent
Yuan

(10) Patent No.: US 8,638,227 B2
(45) Date of Patent: Jan. 28, 2014

(54) INPUT DEVICE, INPUT METHOD AND APPLICATION OF ELECTRONIC COMBINATION LOCK

(75) Inventor: Mengxiao Yuan, Shanghai (CN)

(73) Assignee: Shanghai Buddy Technological Co., Ltd., Shanghai (CN)

( * ) Notice: Subject to any disclaimer, the term of this patent is extended or adjusted under 35 U.S.C. 154(b) by 1205 days.

(21) Appl. No.: 10/575,388

(22) PCT Filed: Aug. 2, 2004

(86) PCT No.: PCT/CN2004/000888
§ 371 (c)(1),
(2), (4) Date: Feb. 21, 2007

(87) PCT Pub. No.: WO2005/035919
PCT Pub. Date: Apr. 21, 2005

(65) Prior Publication Data

US 2007/0133802 A1 Jun. 14, 2007

(30) Foreign Application Priority Data

Oct. 10, 2003 (CN) ..... 2003 1 0106616
Feb. 25, 2004 (CN) ..... 2004 2 0020415
Jul. 19, 2004 (CN) ..... 2004 2 0037690

(51) Int. Cl.
*E05B 45/06* (2006.01)

(52) U.S. Cl.
USPC ..... 340/542; 380/264

(58) Field of Classification Search
USPC ..... 70/278.1; 340/5.55, 5.31
See application file for complete search history.

(56) References Cited

U.S. PATENT DOCUMENTS 4,495,540 A * 1/1985 Remington et al. ..... 361/172
4,745,784 A 5/1988 Gartner (Continued)

FOREIGN PATENT DOCUMENTS

CN 2118774 10/1992
CN 2182850 11/1994

(Continued)

OTHER PUBLICATIONS

International Search Report, Form PCT/ISA/210, mailed Dec. 9, 2004.

*Primary Examiner* — Brian Zimmerman
*Assistant Examiner* — Cal Eustaquio
(74) *Attorney, Agent, or Firm* — Hamre, Schumann, Mueller & Larson, P.C.

(57) ABSTRACT

The invention provides an input device of the electronic combination lock and a corresponding input method thereof, wherein a signal device produces combination input information and converts said information into two groups of electrical pulse signals; a measurement and control device measures the electrical pulse signals, decides the order of the electrical pulse signals and calculates correspondingly such that said signals are converted into character sequences including the combination elements, and decides whether the current combination elements are confirmed to be inputted or not and decides whether the input of all the combination elements is completed or not; a confirmation device produces a conformation signal for inputting the combination elements; and a display device displays said character sequences and preset prompt information in a rolling and refreshing manner. The invention also provides a door lock handle and a panel of the combination lock for the chests and bags applying the above said input device of the electronic combination lock. In said input device of the electronic combination lock and the application thereof, the operation parts do not contact with the circuit, the reliability and the security protection performance have been improved significantly. Furthermore, the operation for inputting the combination and the operation for changing the combination are very convenient and intuitional.

13 Claims, 10 Drawing Sheets

(56) References Cited

U.S. PATENT DOCUMENTS

| | | | | |
|---|---|---|---|---|
| 4,887,445 | A | 12/1989 | Beatty | |
| 4,899,562 | A | 2/1990 | Gartner et al. | |
| 5,517,184 | A | 5/1996 | Dawson et al. | |
| 5,604,489 | A * | 2/1997 | Hyatt, Jr. | 340/5.55 |
| 5,613,388 | A * | 3/1997 | Murphree | 340/5.28 |
| 5,816,084 | A | 10/1998 | Clark | |
| 6,298,699 | B1 * | 10/2001 | Gartner et al. | 70/278.1 |
| 6,353,429 | B1 | 3/2002 | Long | |
| 6,378,344 | B1 | 4/2002 | Gartner | |
| 6,420,958 | B1 * | 7/2002 | Miller et al. | 340/5.55 |
| 6,547,289 | B1 * | 4/2003 | Greenheck et al. | 292/126 |
| 6,734,344 | B2 * | 5/2004 | Laroche et al. | 800/288 |
| 2001/0004584 | A1 * | 6/2001 | Aquilar et al. | 455/90 |
| 2002/0019947 | A1 | 2/2002 | Umezawa et al. | |
| 2002/0087245 | A1 * | 7/2002 | Rossow et al. | 701/50 |
| 2002/0157437 | A1 * | 10/2002 | Laurie | 70/272 |
| 2004/0007032 | A1 * | 1/2004 | Davis | 70/278.3 |
| 2004/0007450 | A1 * | 1/2004 | Kojima et al. | 200/564 |
| 2004/0027793 | A1 | 2/2004 | Haraguchi et al. | |
| 2004/0182120 | A1 * | 9/2004 | Flory et al. | 70/134 |

FOREIGN PATENT DOCUMENTS

| | | |
|---|---|---|
| CN | 2457282 | 10/2001 |
| DE | 3941426 | 6/1991 |
| DE | 29903038 | 4/1999 |
| EP | 0030587 | 6/1981 |
| EP | 0475301 | 3/1992 |
| EP | 0750327 | 12/1996 |
| EP | 1132933 | 9/2001 |
| EP | 1336914 | 8/2003 |
| EP | 1394666 | 3/2004 |
| GB | 2186668 | 8/1987 |
| GB | 2297354 | 7/1996 |
| JP | 62-21952 | 5/1987 |
| JP | 63-46562 | 3/1988 |
| JP | 3-34383 | 4/1991 |
| JP | 6-264660 | 9/1994 |
| JP | 08-184235 | 7/1996 |
| JP | 9-78909 | 3/1997 |
| JP | 10-504075 | 4/1998 |
| JP | 2000-73632 | 3/2000 |
| JP | 2001-268613 | 9/2001 |
| WO | 95/12047 | 5/1995 |
| WO | 00/23679 | 4/2000 |
| WO | 02/099617 | 12/2002 |

* cited by examiner

INPUT DEVICE, INPUT METHOD AND APPLICATION OF ELECTRONIC COMBINATION LOCK

TECHNICAL FIELD

The present invention relates to an electronic combination lock, particularly, to an input device of the electronic combination lock, an input method used for the electronic combination lock, and the application of the input device of the electronic combination lock.

BACKGROUND ART

To enable and to set the combination of a prior mechanical dial-type combination lock are implemented by the mechanical linkage mechanism inside the combination lock. Accurate positioning is required for enabling the combination and setting the combination of such combination lock, particularly, it is more complicated to modify the cipher, in addition to that the lock body is required to disassemble, it is very difficult for the person who have not been trained professionally to complete the operation of setting the code. Furthermore, the amount of the secret keys of said method depends on the amount of the directive wheels inside the mechanical linkage mechanism. In order to obtain a large amount of secret keys, the amount of the directive wheels shall be increased so that the volume and the complexity of the structure will be increased. Therefore, people attempt more and more to use the electronic combination lock, which can be operated conveniently and has a compact structure.

It has been disclosed in the U.S. Pat. No. 6,420,958 an electronic digital lock, it uses a dial coupled to a step motor, when rotating the dial, the signals are generated by the step motor, and are outputted to a microcomputer for counting process via a shaping circuit, and are displayed by a display device. When the rotation of the dial is stopped, the numbers displayed are inputted as a part of the code combination. Since the structure of the step motor is complicated and the price is rather high, and the peripheral circuits, such as the shaping circuit, and the like, are required, therefore the manufacturing cost of such electronic digital lock is relatively high.

Additionally, the input devices of dial-type electronic combination locks have been disclosed in U.S. Pat. No. 4,745,784 and U.S. Pat. No. 4,899,562 respectively, they have the similar structure. The input device of the electronic combination lock comprises a dial, a contact tip which is fixed inside the dial and can be rotated together with the dial, and ten contact points which are distributed as a circle or a half circle corresponding to the moving track of the contact tip and connected to a circuit board. The dial is depressed axially when the dial is rotated to a certain calibration position, and an electrical signal is produced by the contact between the contact tip thereon and a certain contact point corresponding to said calibration position. The electrical signal of each of the contact points corresponds to a different number, and this number is confirmed as an element of the combination.

An input device of the dial-type electronic combination lock has also been disclosed in Japanese Patent P2000-73632. It comprises a conducting sheet fixed on the dial, and two groups of contact points, which contact with the conducting sheet and are distributed intermittently as a circle, and a conducting ring, which is connected electrically with the contact point groups and supplies the power thereto. When rotating the dial, the above two contact point groups are contacted and are turned on intermittently with and by the conducting sheet, and two groups of electrical pulse signals can be obtained from the output leads of the two groups of the contact points. The signals are processed and displayed as the combination elements. In this technical scheme, a confirmation device for confirming the combination code is a button switch installed on the dial.

The electrical signals representing the combination are produced directly by employing the electrical contact method in the above said three kinds of input devices of the electronic combination lock, therefore a problem of the contact reliability may be caused. Particularly, in the input device of the electronic combination lock of the Japanese Patent P2000-73632, there is also the problem of the abrasion due to the contact friction. Furthermore, since the electrical signals representing the combination are inputted directly without isolation, the security protection performance is also insufficient.

Furthermore, most of the prior combination locks are in the form of numeral keyboard, in most of the cases, the keyboard is installed on the panel of the lock body above the handle of the door lock. However, for a handle of combination lock disclosed in U.S. Pat. No. 6,378,344, the numeral keyboard is embedded in the handle of the lock, and the combination is inputted through the keyboard. Since the plane size of the keyboard is large, the volume of the handle is larger than that of a normal handle, thus, it will bring about an uncomfortable feeling when using said handle.

Most of the prior combination locks used for the chests and bags are in the form of mechanical roller, as described above, the structure of the mechanical combination lock is complicated, and it is inconvenient to operate it. For example, for a mechanical combination lock used for the chests and bags as disclosed in the Chinese Patent ZL00261865.6, though it has four digit wheels and employs new structure to simplify the operation for changing the combination, but the disadvantages, such as the amount of the combination keys being small, the mechanical operation for changing the combination being complicated, still exist.

SUMMARY OF THE INVENTION

The object of the invention is to overcome the disadvantages in the prior art and to provide an input device of the electronic combination lock, which has a high reliability and an excellent security protection performance, and the input and the set of the combination is simple and convenient.

The invention also provides a combination lock handle including said input device of the electronic combination lock, and a panel for the combination lock used for the chests and bags, their structures are simple and compact, the amount of the secret keys is large, the volume is small and the operation for inputting the combination is intuitional and convenient.

Another object of the invention is to provide an input method used for inputting the combination of an electronic combination lock, and the combination can be inputted reliably, safely and conveniently by this method.

According to the first aspect of the invention, it provides an input device of an electronic combination lock, comprising: a signal device for producing combination input information and for converting said information into two groups of electrical pulse signals; a measurement and control device connected with said signal device for measuring the electrical pulse signals outputted from the signal device, deciding the order of the electrical pulse signals and calculating correspondingly such that said signals are converted into character sequences including the combination elements, and deciding whether said combination elements are confirmed to be inputted or not and deciding whether the input of all the combination elements is completed or not; a confirmation device connected with said measurement and control device and used for producing a conformation signal for inputting the combination elements to indicate that the input of the current combination element is confirmed; and a display device connected with said measurement and control device for displaying said character sequences and preset prompt information in a rolling and refreshing manner by the driving of said measurement and control device.

Preferably, in the input device of the electronic combination lock of the invention, said confirmation device is a switch device, an electrical signal produced when it is closed allows said measurement and control device to confirm the current combination element displayed by said display device as a part of the input combination.

Preferably, in the input device of the electronic combination lock of the invention, the measurement and control device is also used for deciding whether during a given timing period which starts each time when a signal is produced by a switch device, the timing period expires or not. If the timing period expires, then it decides that the input is during overtime.

The preset information displayed by said display device is indicated by symbols, wherein the close and open states of the lock are indicated by a symbol having a padlock shape, the time at which the lock is opened on time or is delayed to be opened is indicated by a symbol having a clock shape, the code setting state is indicated by a symbol having a key shape, and low power of battery is indicated by a symbol having a battery shape, and the confirmation states of the respective parts of the combination are indicated in turn by the remaining dot symbols.

The above input device of the electronic combination lock may be an input device of a dial-type electronic combination lock. Wherein the signal device comprises: a panel body, a dial which is installed on said panel body and can be rotated freely, a drive shaft fixed at the center of said dial, a set of driving gears installed on said drive shaft, a driven gear which engages with said driving gears, and a rotating coder connected with said driven gear on the same shaft. Wherein the measurement and control device is a programmed microcontroller, the display device is an information display screen, and the switch device is a photoelectric switch. Said microcontroller, coder, information display screen and photoelectric switch are provided on the same circuit board, said circuit board is provided within said panel body, and said microcontroller is connected electrically with said coder, information display screen and photoelectric switch respectively.

Preferably, in the above said input device of the dial-type electronic combination lock, the outer edge of said dial is a circular skirt-like fringe, the position of said photoelectric switch corresponds to the skirt-like fringe of said dial, when said dial is depressed, the light transmitted to the photoelectric switch is blocked by said skirt-like fringe, thereby a signal is produced by said photoelectric switch.

Optionally, in the above said input device of the dial-type electronic combination lock, the upper part and lower part of said panel body are hunched ear-edge shaped, and said panel body further comprises: grooves provided in back of said ear-edge and matched with the fingers; a display window, which matches with the shape and size of said information display screen, and forms a oblique angle together with said information display screen for viewing effectively; and a guiding hole provided at the display window side of said panel body for inserting an emergency key.

In the above said input device of the dial-type electronic combination lock, it further comprises a reset spring installed axially within an internal hole provided in the drive shaft of said dial.

Alternatively, in the above said input device of the electronic combination lock, concentric circle plane tooth grooves are provided on the internal end face of said driving gear, and a blind hole is provided on said plane gullet at a position corresponding to said panel body, and a steel ball and a spring are installed in said blind hole, under the action of the spring, said steel ball contacts and matches with the concentric circle plane tooth groove of said driving gear.

Furthermore, the above said input device of the electronic combination lock can also be an input device of a roller type electronic combination lock. Wherein the signal device is a roller device, it comprises: a roller, a coder which is coaxial with the roller, and an elastic bracket for supporting said roller. Wherein the measurement and control device is a programmed microcontroller, the display device is an information display screen, the switch device is a microswitch provided below the shaft extension of the roller. Said microcontroller is connected electrically with said coder, information display screen and microswitch, respectively.

Preferably, in the above said input device of the roller type electronic combination lock, 1-bit or 2-bit number is displayed on the information display screen in an ascending order or descending order circularly rolling manner according to the rotation direction and angle of said roller. When the roller is depressed, the microswitch is actuated by the shaft extension of said roller, thereby the rolling display of said information display screen is stopped, so that the current number displayed is confirmed as a part of the combination. After releasing the depressed roller, said roller is reset by the elastic bracket.

According to the second aspect of the invention, it provides a handle of the combination lock, which is hollow, and comprises: an input device of the roller type electronic combination lock of the invention, which is fixed within a cavity in said handle; a first window, which corresponds to said roller thereby said roller may be dialed and depressed, provided on the surface of the handle, a second window, which corresponds to said information display screen thereby the contents displayed may be viewed, provided on the surface of the handle; and a rotation shaft fixed in the handle with a through-hole used for the wires to be passed through provided therein. The input device of the electronic combination lock is connected with a combination identification device of the lock and a power supply, which are installed inside the core mechanism of the lock or installed at other position inside the door, via the wires.

The invention further provides another handle of the electronic combination lock, said handle is hollow and comprises: a handle body, a panel and a transparent window cover. Said handle body comprises a rotation shaft fixed therein, and a through-hole provided inside said rotation shaft for allowing the connection wires to be passed through. The input device of the roller type electronic combination lock of the invention is installed within the panel body, a first window, which corresponds to said roller thereby said roller may be dialed and depressed, and a second window, which corresponds to said information display screen thereby the contents displayed may be viewed, are provided on said panel. Said transparent window cover is provided on a plane on which there is said second window. A hollowed region, which has the size and shape matching with said panel, is provided on the front surface of the handle body, thereby said panel can be embedded therein. Said handle of the combination lock is connected to a combination identification device and a power supply of the combination lock which are installed inside the core mechanism of the lock or installed at other positions inside the door via the wires.

The invention further provides yet another handle of the combination lock, and it comprises: a handle body, a handle base and a panel. The microcontroller and information display screen in the above input device of the roller type electronic combination lock are installed inside the handle base, and the second window, which corresponds to said information display screen thereby the displayed contents may be viewed, is provided on the front surface of the base. The roller device in the input device of the electronic combination lock of the invention is fixed inside the panel body, and the first window having the size and shape matching with the roller thereby said roller may be dialed and depressed is provided on the surface of said panel. Wherein said handle is hollow, and a cavity matching with the size and shape of said panel is provided on its front surface, thereby said panel can be embedded therein. Said input device of the roller type electronic combination lock is connected to a combination identification device and a power supply of the combination lock which are installed inside the core mechanism of the lock or installed at other positions inside the door via the wires.

According to the third aspect of the invention, it provides a panel of a combination lock for the chests and bags, the panel of the combination lock for the chests and bags is fixed on the external surface of the chest body. It comprises: an input device of the electronic combination lock of the invention installed within said panel body; a first window, matching with the size and shape of said roller thereby said roller may be dialed and depressed, provided on the surface of said panel; and a second window, matching with the size and shape of said information display screen and having a transparent window cover provided thereon thereby the displayed contents may be viewed, provided on said panel. Wherein said input device of the combination lock is connected to a combination identification device and a power supply of the combination lock which are installed inside the chest body via the wires.

According to the fourth aspect of the invention, it provides a method for inputting the combination of a combination lock, and the method comprises the following steps: receiving rotation information of the dial or roller via a signal device and converting it into two groups of electric pulse signals; measuring, deciding and calculating said two groups of electric pulse signals by a measurement and control device, and further converting them into element sequence constituted by the combination; displaying character sequences including combination elements and preset information by a display device, wherein the rolling refreshing rate for displaying the character sequences including combination is a function of the signal frequency of said two groups of electric pulse signals, the element sequence of the combination is rolling refreshed in an ascending order or descending order manner, which corresponds to the rotation direction and angle of said dial or roller; when the input of the current combination element is confirmed, a confirmation signal for inputting the combination element is produced by a confirmation device; after said electrical signal is detected by the measurement and control device, the currently inputted combination element is confirmed; and the measurement and control device further decides whether the input of all of the combination elements is completed or not.

Preferably, the above said input method for the combination further comprises the following steps: when a signal is produced by said confirmation device, a given timing period is started, after that, whether the timing period expires or not is decided by the measurement and control device, if the timing period expires, then it decides that the input is during overtime.

By using the above said input device and input method of the electronic combination lock, it makes the input device of the electronic combination lock of the invention have simple structure, the input combination signals be isolated by using mechanic-electric or optical-electric isolation, no electrical contact exist between the operating parts and the circuits, therefore it improves significantly the reliability and the security protection performance. Furthermore, the operation for inputting combination and the operation for modifying combination are also very simple and intuitional.

Particularly, when the input device of the electronic combination lock of the invention is a dial-type, the above advantages will be more outstanding. Furthermore, the structure of the input device of the dial-type electronic combination lock is novel and inimitable, and the way for the open operation of the combination lock further accords with the conventional operation custom.

When the input device of the electronic combination lock of the invention is a roller type, its structure is more compact and its volume is smaller, it is convenient for applying it in a variety of situations. After applying it to the handle of the lock, the handle function and the combination input function as well as the display function of the combination and information can be integrated in one so that the disadvantage of the large volume of the handle of the electronic combination lock of the prior art is overcome. After applying it to the chests and bags, not only the amount of the secret keys is large and the operation for modifying the combination becomes more simple and convenient, but also the comfortable feeling of the operation will be better than that of the mechanical roller type combination lock used for the chests and bags.

BRIEF DESCRIPTION OF APPENDED DRAWINGS

The invention will be further described in detail by referring to the drawings and embodiments as follows. In the drawings, the same reference number indicates the same or corresponding parts. The above and other objects, features and advantages of the invention will become more apparent through the following description.

Figure 11:
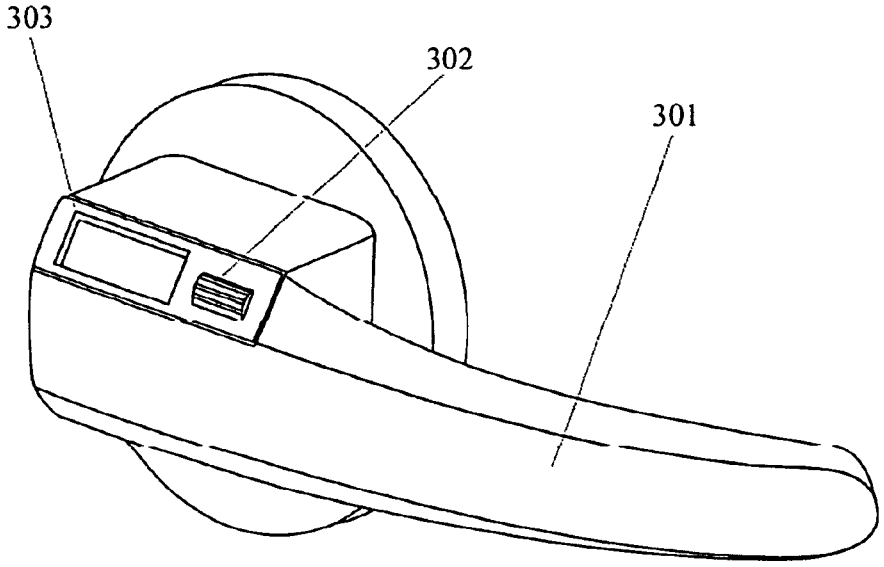
FIG. 11 shows an external structure of a handle of combination lock according to the invention.
Figure 12:
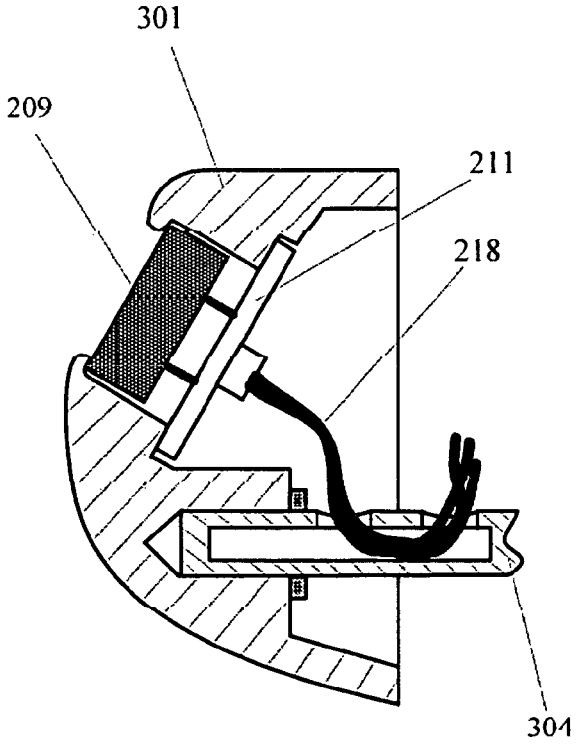
Figure 13:
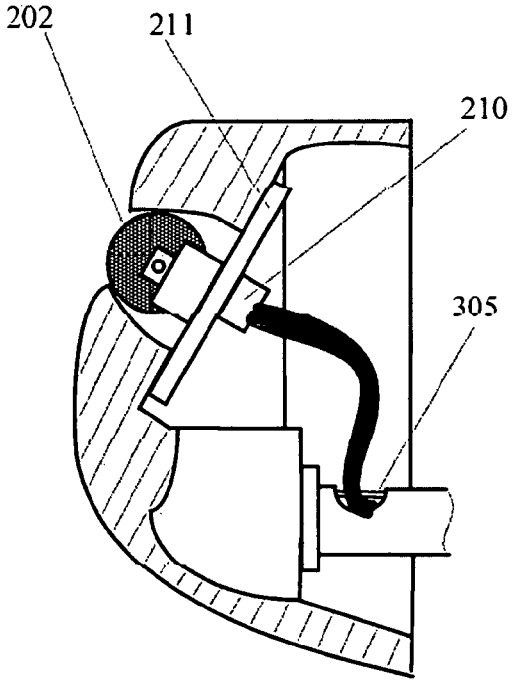
Figure 14:
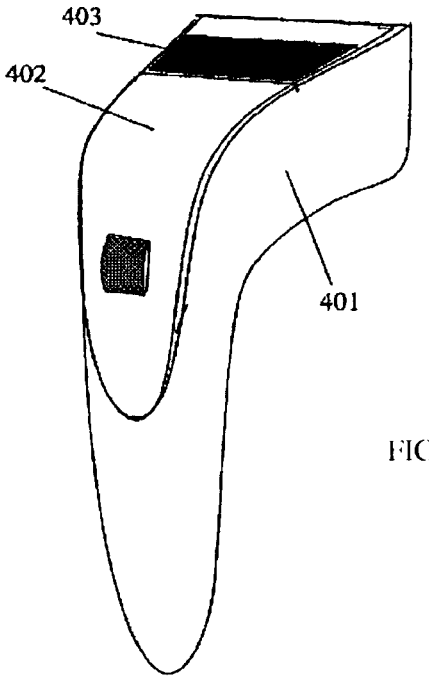
Figure 15:
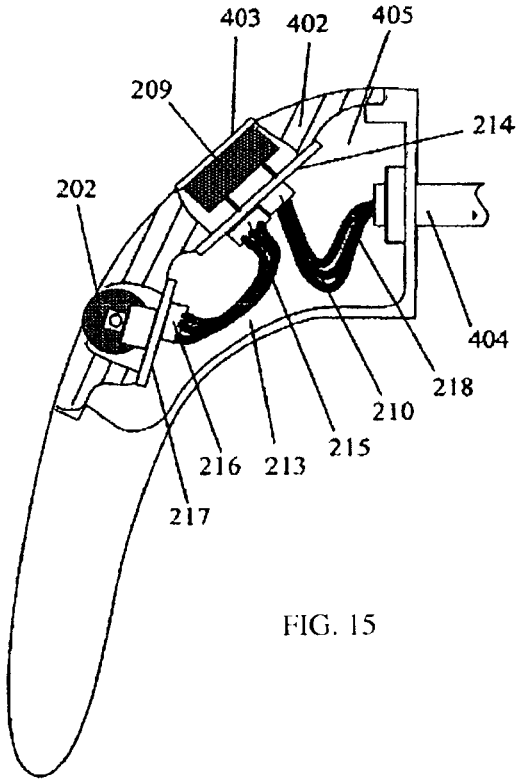
Figure 16:
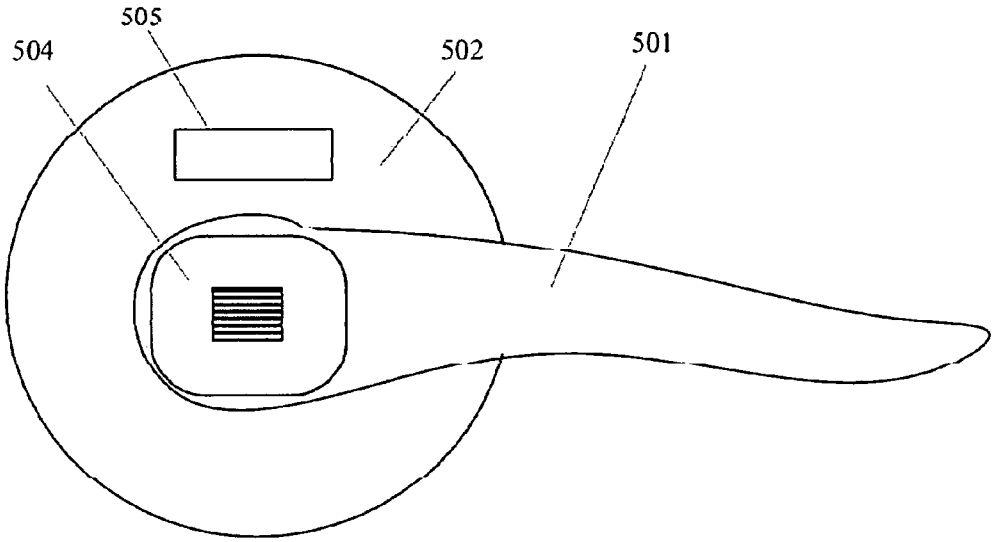
Figure 17:
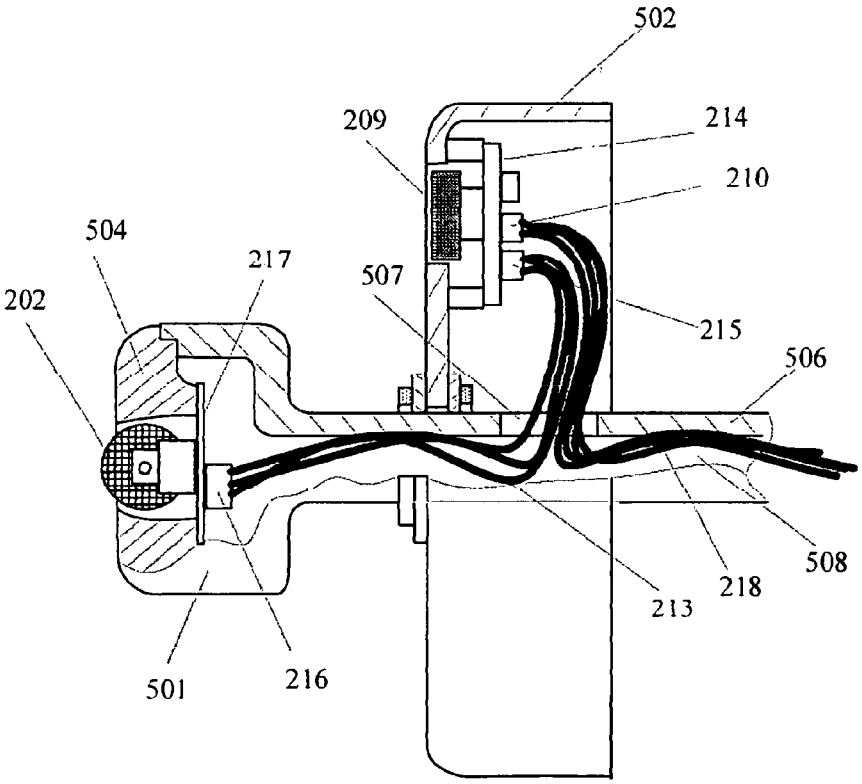
Figure 18:
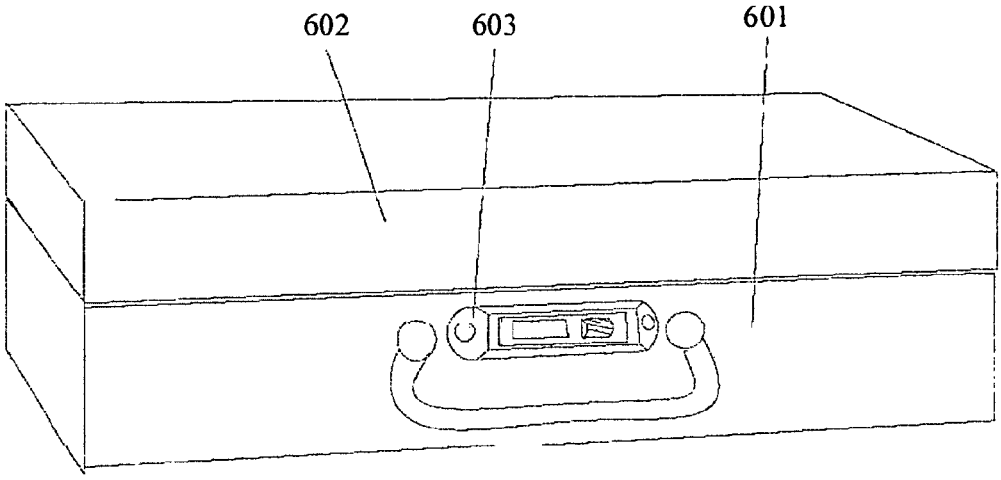
Figure 19:
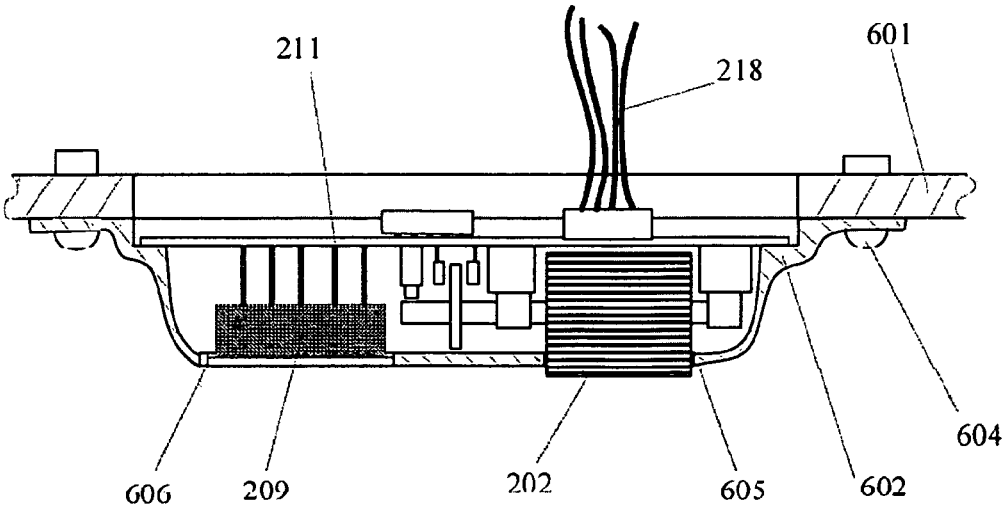

FIG. 12 and FIG. 13 exhibit commonly an internal structure of the handle of a combination lock as shown in FIG. 11;

FIG. 14 shows an external structure of another handle of combination lock according to the invention;

FIG. 15 exhibits an internal structure of the handle of combination lock shown in FIG. 14;

FIG. 16 shows an external structure of another handle of combination lock according to the invention;

FIG. 17 exhibits an internal structure of the handle of combination lock as shown in FIG. 16;

FIG. 18 shows an external structure of the panel of the lock for the chests and bags according to the invention; and FIG. 19 exhibits an internal structure of the panel of the lock for the chests and bags as shown in FIG. 18.

DETAILED DESCRIPTION OF PREFERRED EMBODIMENTS

The input device, input method and the application of the electronic combination lock of the invention will be further described by incorporating several specific embodiments as follows.

Input Device of the Electronic Combination Lock

Figure 1:
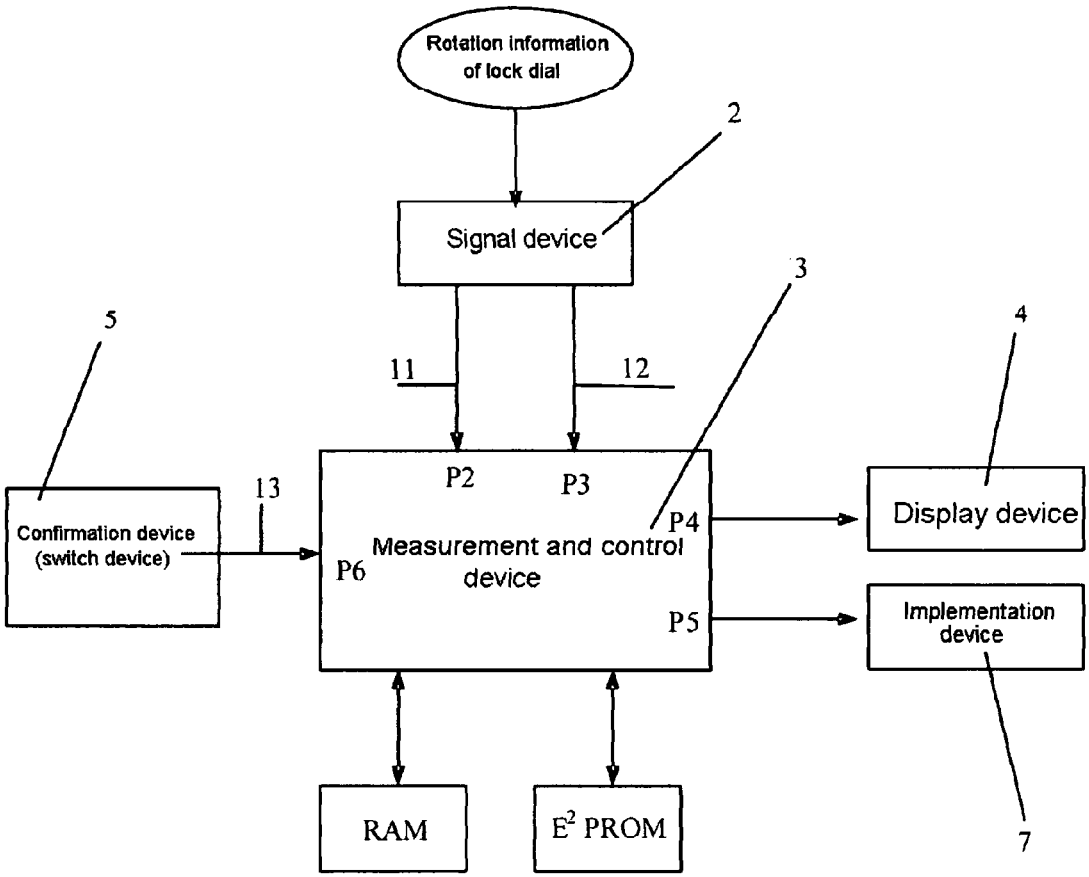
FIG. 1 is a structure block diagram according to a first embodiment of the invention.

FIG. 1 shows an input device of the electronic combination lock according to the first embodiment of the invention. As shown in the drawing, said input device of the electronic combination lock is composed of a signal device 2, a measurement and control device 3, a display device 4 and a confirmation device 5.

The signal device 2 can employ an electromechanical rotation coder, the rotor of the coder has a mechanical driving relationship with the dial and rotates following the dial. The coder has two code signal output terminals, when the dial rotates in a clockwise direction, the electrical pulse signal 11 outputted from the first output terminal keeps ahead; when the dial rotates in a counterclockwise direction, the electrical pulse signal 12 outputted from the second output terminal keeps ahead. The number of the pulses included in the two groups of electrical pulse signals is proportional to the angle through which the rotor of the coder has rotated, and the frequency of the pulse signals is proportional to the rotation rate of the rotor of the coder.

The measurement and control device 3 is composed of a single-chip microcomputer and the peripheral circuits thereof, and a single-chip microcomputer having integrated RAM and ROM therein can be used for measuring the electrical pulse signals 11 and 12 outputted by the signal device 2, deciding the order of said electrical pulse signals, and calculating correspondingly such that said signals are converted into character sequences including the combination elements, and deciding whether the current combination elements are confirmed to be inputted or not and deciding whether the input of all of the combination elements is completed or not. ROM stores the control program and the preset data information, RAM stores the data information, such as the measuring data, displaying data and other intermediate data; EEPROM is required to be set further, and the unlocking combination, the setting combination and the verification combination are stored therein in advance. The single-chip microcomputer comprises several I/O ports P2~P6, wherein the measurement and control device 3 receives the two groups of electrical pulse signals 11 and 12 converted by the signal device 2 via the ports P2 and P3, the port 6 is connected with the confirmation device 5, the port P4 is connected with the display device 4, the port P5 can be connected optionally with the implementation device 7 of the electronic combination lock.

As shown in FIG. 1, in order to achieve preferably the technical results of the invention, the confirmation device 5 in the present embodiment is a switch device, the close of the switch device 5 is controlled by the axial motion of the dial, when the dial is not depressed the switch device 5 is in a disconnection state, and when the dial is depressed the switch device 5 is closed, and the close action produces an electrical signal 13 at two terminals of the switch device 5, said signal is directed to I/O port P6 of the measurement and control device 3 as a confirmation signal for inputting an element of the input combination.

Furthermore, in the input device of the electronic combination lock as shown in FIG. 1, each time when a signal is produced by the switch device 5 thereby starting a given timing period, said measurement and control device 3 decides whether a timing period expires or not, if the timing period expires, then it decides that the input is overtime.

Said character sequence and preset prompt information are displayed by the display device 4 under the driving of the measurement and control device 3 in a roll refreshing manner. Wherein the preset information is indicated by symbols, with reference to FIG. 6, the close state and open state of the lock are indicated by a symbol having a padlock shape, the time at which the lock is opened on time or is delayed to be opened is indicated by a symbol having a clock shape, the code setting state is indicated by a symbol having a key shape, and low power of battery is indicated by a symbol having a battery shape, and the confirmation states of the respective parts of the combination are indicated in turn by the remaining dot symbols.

The operation principle and flow process of the input device of the electronic combination lock of the invention will be described in detail with reference to FIG. 2, they can be achieved by the program stored in ROM.

Figure 2:
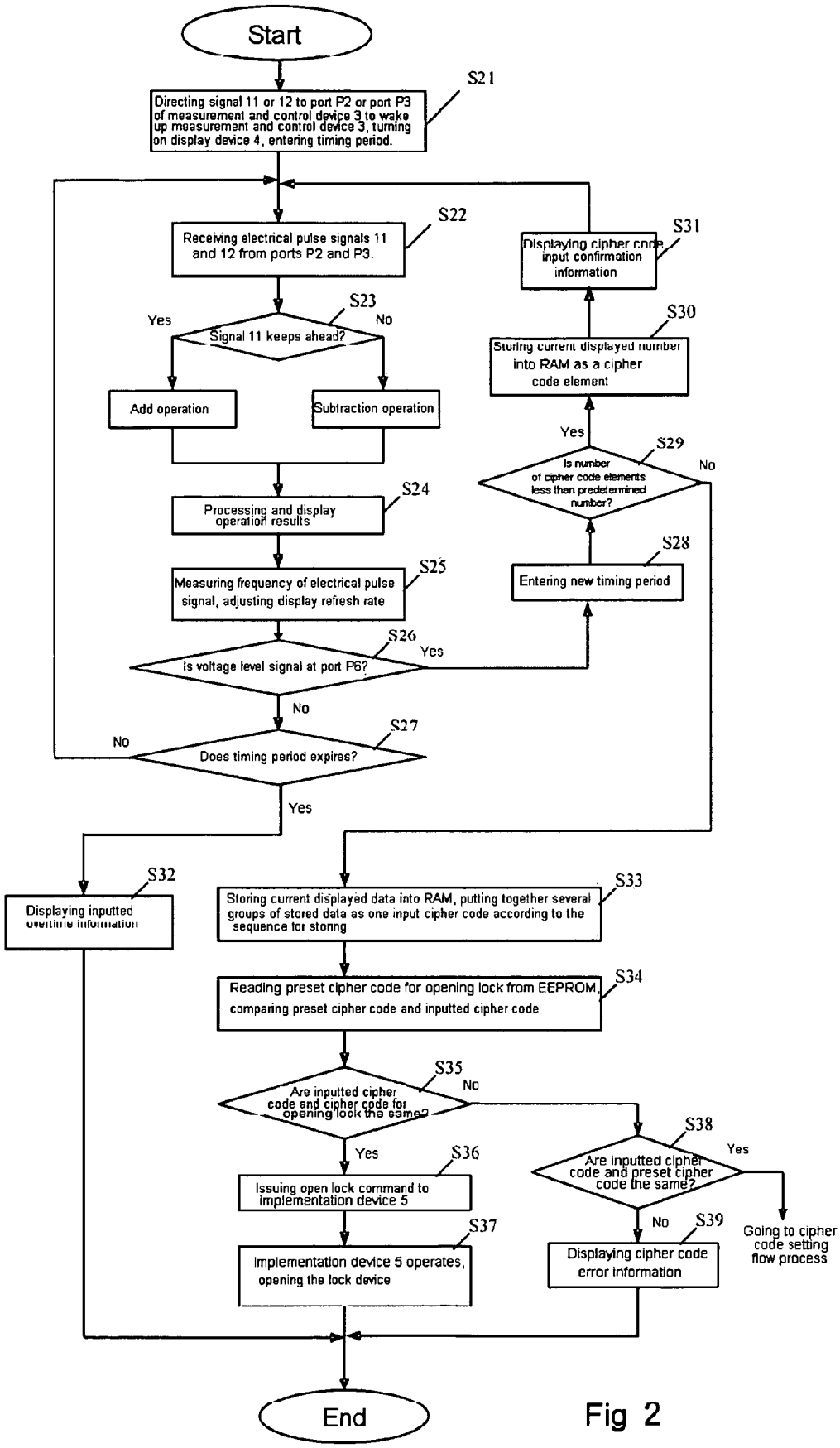
FIG. 2 is a flow chart according to the first embodiment of the invention.

As shown in FIG. 2, in step S21, the signal device 2 is rotated by the dial and electrical pulse signals 11 and 12 are produced, the two groups of signals are directed to the I/O ports P2 and P3 of the measurement and control device 3, the measurement and control device 3 will be waked up from a low power consumption state regardless of which direction the dial rotates and changed to an operation state thereby turning on the display device 4. Then, the first group of electrical pulse signals 11 and the second group of electrical pulse signals 12 are received by the I/O ports P2 and P3 of the measurement and control device 3, and the measurement and control device 3 proceeds to the timing period under the control of the program, and the timing program begins timing from zero. Meanwhile, the input flow process of the entire electronic combination lock proceeds to step S22.

As shown in the drawing, in step S22, the received electrical pulse signals 11 and electrical pulse signals 12 are measured by the measurement and control device 3. Next, in step S23, the successive order of the electrical pulse signals 11 and 12 are decided by the measurement and control device 3. If the electrical pulse signals 11 keep ahead, then an add operation will be performed for the change amount of the pulses measured currently and the accumulation sum of the amount of the pulses measured previously; if the electrical signals 12 keep ahead, then an subtraction operation will be performed for the change amount of the pulses measured currently and the accumulation sum of the amount of the pulses measured previously. Next, in steps S24 and S25, after the above operation results are data processed by the measurement and control device 3, the display device 4 is driven via the I/O port P4 to display in a decimal number manner, and the display refresh rate of the above operation results is adjusted according to the proportional relationship of the measured frequency of the electrical pulse signals, meanwhile, the flow process proceeds to step S26.

In step S26, the measurement and control device 3 detects firstly whether a signal is inputted at I/O port P6, if the electrical level signal 13 outputted from the switch device 5 is not detected, then the measurement and control device 3 detects in step S27 whether the time counted by the overtime counting program expires or not. If the time counted by the overtime counting program has not expired, then it proceeds to step S22. If the time counted by the overtime counting program has expired, then it proceeds to step S32, and an overtime alarm signal is issued, meanwhile, an input overtime information is displayed by the display device 4. If the measurement and control device 3 detects the electrical level signal 13 outputted by switch device 5, after the combination element displayed currently on display device 4 is confirmed and stored into RAM, a combination receiving confirmation information is displayed by the display device 4 under the driving of the I/O port P4, meanwhile, the flow process proceeds to step S28 to enter a new timing period.

In step S29, the measurement and control device 3 counts the received combination elements which have been confirmed, and compares the counting result with a preset number, if the counting result is less than the set number, then it proceeds to step S30. In step 30, the measurement and control device 3 stores the number displayed currently into RAM as a combination element, and next in step S31, the display device 4 is driven to display the combination input confirmation information, meanwhile, the flow process goes back to step S22. If the counting result is equal to the set number, a complete set of combination elements are confirmed to have been received, and the flow process goes to step S33. In step S33, after the measurement and control device 3 performs the operation of linking several combination elements, which have been inputted and confirmed, in sequence and they are stored into RAM again, the display device 4 displays the combination receiving completion information under the driving of the I/O port P4. At this time, the entire input flow process for the electronic combination lock is completed, other operation flow process can be entered selectively from step 34 as required.

For example, the combination can be set through the above method steps for inputting the combination. The preset combination is inputted firstly such that the input device of the electronic combination lock of the invention enters a combination setting state, then a new unlocking combination can be inputted under said state to substitute the old combination, and the new combination can be used for unlocking afterwards. The details can be referred to FIG. 2. In step S34, the unlocking combination and set combination, which are preset, are read from EEPROM, and are compared with the inputted combination. Then in step S35, whether the inputted combination is the same as the unlocking combination or not is decided. If they are the same, then it will proceed to step S36, and an open lock command will be issued to the implementation device 7. Then in step S37, the implementation device 7 opens the closed lock device. If it is decided in step S35 that they are different, then it will proceed to step S38, whether the inputted combination and the preset combination are the same or not is decided. If they are the same, then it will proceed to the combination setting flow process, otherwise, the display device 4 will display a combination error information in step S39.

Input Device of the Dial-Type Electronic Combination Lock

Figure 3:
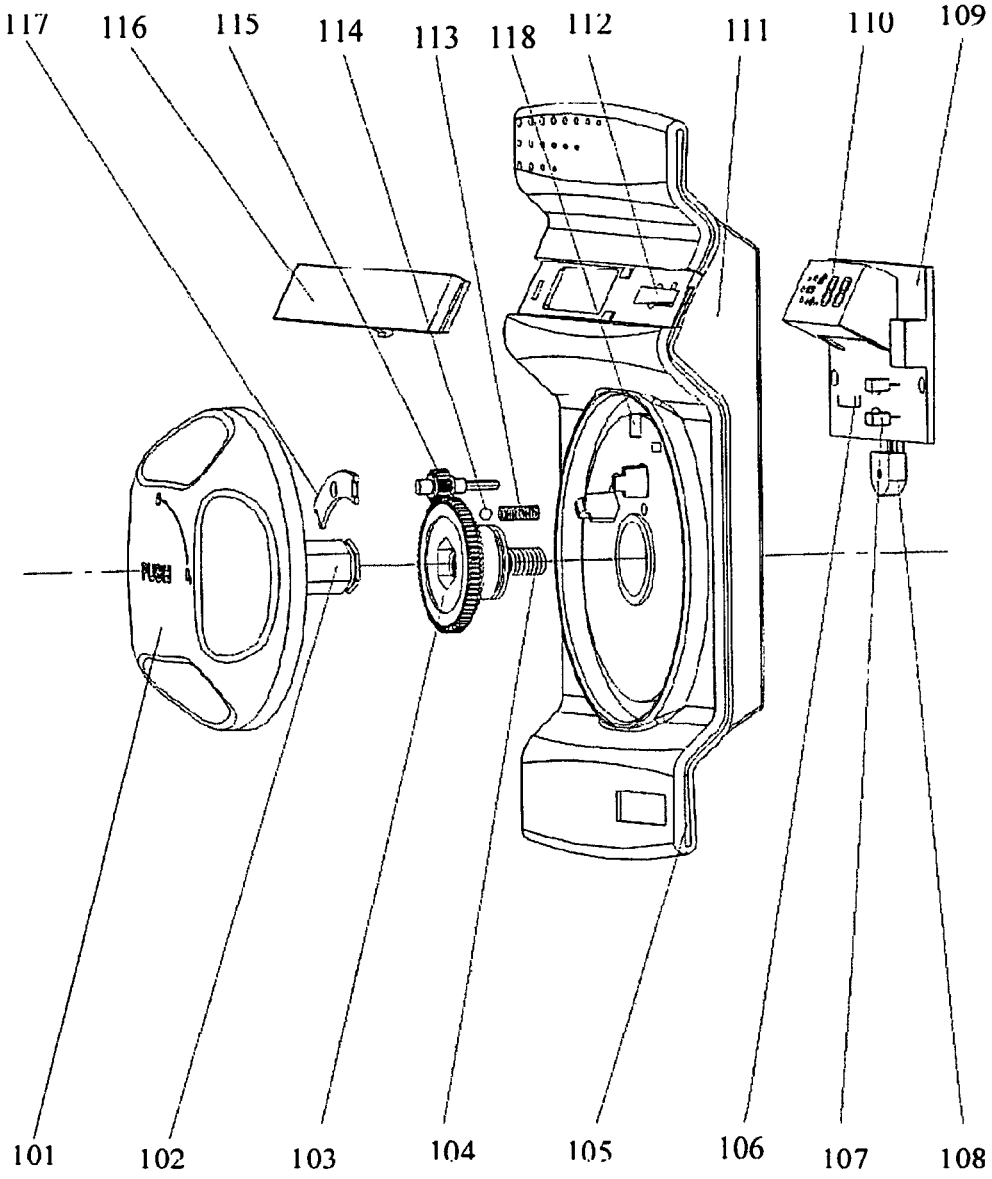
FIG. 3 is a schematic structure diagram according to a second embodiment of the invention.

The input device of the electronic combination lock of the invention can also be produced specifically as a dial form as required, just as shown in the second preferred embodiment of the invention. As shown in FIG. 3, when it is produced as an input device of a dial-type electronic combination lock, a signal device 2 comprises: a panel body 111, a dial 101 which is installed on said panel body 111 and can be rotated freely, a drive shaft 102 fixed at the center of said dial 101, a set of driving gears 103 installed on said drive shaft 102, a driven gear 115 which engages with said driving gear 103, and a rotating coder 108 connected with said driven gear 115 on the same shaft. A measurement and control device 3 is a programmed microcontroller (hereinafter refer to as MCU) 106, a display device 4 is an information display screen 110, and a switch device 5 is a photoelectric switch 107.

In the above drawing, the MCU 106, coder 108, information display screen 110 and photoelectric switch 107 are provided on a circuit board 109, said circuit board 109 is provided within said panel body 111. A mechanical-electrical rotation coder can be used as the coder 108. An infrared photoelectric switch is used as the photoelectric switch 107, comprising a transmitter tube and a receiver tube. A single-chip microcomputer having ROM, RAM and several I/O ports is employed as the microcontroller, and the control program being installed in the ROM. The I/O ports on MCU are connected with the coder 108, photoelectric switch 107, and information display screen 110 respectively, wherein one I/O port is connected with the combination identification device of the combination lock for data communicating.

The dial 101, drive shaft 102, driving gears 103, driven gear 115, and the rotor of the coder 108 constitute a simple driving system. Specifically, the cross section of drive shaft 102 is a regular polygon, one end of the shaft being fixed at the center of the dial 101, a internal regular polygon hole is provided on the driving gears 103 for adapting the other end of the drive shaft 102 to be inserted into. A movable fit exists between a cylindrical face at one side of the driving gears 103 and the corresponding internal hole of the panel body 111. The driven gear 107 engages with the driving gears 115, and a movable fit exists between two cylindrical faces of the driven gear 115 and the internal hole of the gear pressboard 117, another internal hole of the panel body 111 respectively, the gear pressboard 117 is snapped on two supporting posts of the panel body 111, the cross section of the shaft extension of the driven gear 115 is a regular polygon, the shaft extension as the drive shaft of the rotor of the coder 108 is inserted into the internal regular polygon hole of the rotor of the coder 108. In this driving system, the function of the panel body 111, gear pressboard 117, and the like is supporting and the positioning.

The dial 101 and drive shaft 102 can displace axially 2 to 4 mm, an internal hole 122 is provided axially at the another end of the drive shaft 102, and a reset spring 104 is provided in the hole. Two slot openings 118, corresponding to the transmitter tube and receiver tube of the photoelectric switch 107, are provided on the panel body 111.

Figure 5:
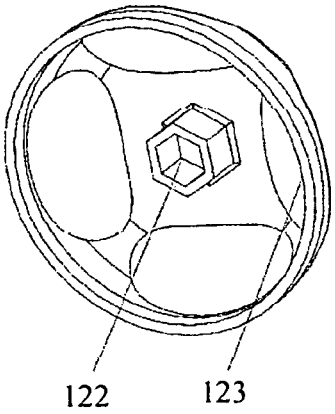
FIG. 5 shows a structure of a dial in the second embodiment of the invention.

FIG. 5 shows a structure of the dial in the second embodiment of the invention. As shown in the drawing, the internal edge of the dial 101 has a circular skirt-like fringe 123, said skirt-like fringe corresponds to a position between the transmitter tube and the receiver tube of the photoelectric switch 107 on the circuit board 109. When the dial 101 is depressed, the light signal of the photoelectric switch 107 is blocked by the skirt-like fringe 123, causing the electrical signal outputted from the photoelectric switch 107 to change, and the electrical signal is transmitted to MCU 106, when the change of the signal is detected by MCU 106, the number displayed currently is confirmed and stored as a part of the combination. After releasing the external force for depressing the dial 101, the dial 101 and drive shaft 102 are reset under the reset function of the reset spring 104.

Figure 4:
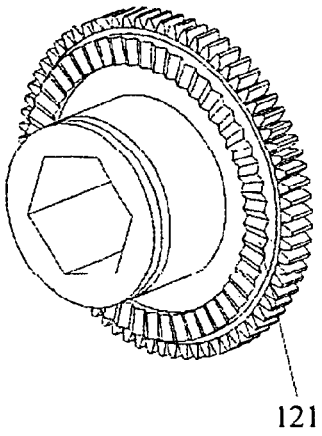
FIG. 4 shows a structure of a driving gear in the second embodiment of the invention.

The shape of driving gears 103 is shown in FIG. 4, a simple mechanism is constituted by a concentric circle plane gullet 121 provided on the internal end face of said driving gear, and a steel ball 114, a spring 113 and a corresponding blind hole provided on said panel body 111. Under the action of the spring 113, said steel ball 114 contacts and matches with the concentric circle plane gullet 121 of said driving gear 103, the function of which is during the procedure of rotating the dial 101, as the displayed number changes dynamically, a hand feeling, which synchronizes with the refresh of the displayed number, will be produced.

Figure 6:
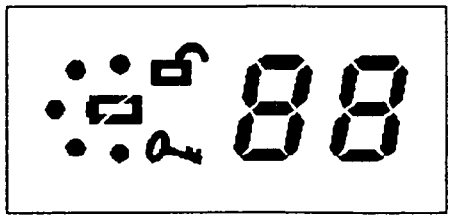
FIG. 6 is a schematic plan diagram showing an information display screen in the second embodiment of the invention.

An eight-segment LED for displaying the prompt information symbols and two seven-segment LED for displaying number are provided on the information display screen 110, as shown in FIG. 6, wherein the close state and open state of the lock are indicated by a symbol having a padlock shape, the time at which the lock is opened on time or is delayed to be opened is indicated by a symbol having a clock shape, the code setting state is indicated by a symbol having a key shape, low power of battery is indicated by a symbol having a battery shape, and the confirmation states of the respective parts of the combination are indicated in turn by the remaining dot symbols.

The display face of the information display screen 110 is an oblique face, the oblique angle thereof makes user's line of sight be approximately perpendicular to the display face of information display screen 110 so that it accords with the principle of the human body engineering. The plane of the display window of the panel body, which corresponds to the display face of the information display screen 110, is also an oblique face having the same angle. A transparent window cover 116 is snapped on the plane on which there is the display window of said panel body.

The upper part and lower part of said panel body 111 are hunched to be ea-edge-shaped 105 to serve as a handle, and grooves are provided on the internal side (back part) of said ear-edge 105 and matched with the fingers so that the operation of opening the door is easy. Furthermore, a guiding hole 112 is provided at the display window side of said panel body for inserting a mechanical emergency key.

During assembling, the circuit board 109 is fixed at other side of the panel body 111, the cylindrical face of the driving gears 103 is installed into a corresponding hole on the panel body 111, the cylindrical face at one end of the driven gear 115 which is engaged with the driving gears 103 is installed into a corresponding hole of the panel body 111, the shaft extension thereof is inserted into an internal hole of the rotor of the coder 108, a middle hole of the gear pressboard 117 is fitted with the cylindrical face at another end of the driven gear 115, and the gear pressboard 117 is snapped by two supporting post on the panel body 111, the steel ball 114 and spring 113 are installed into a corresponding hole on the panel body 111, the drive shaft 102 is inserted into a polygon hole of the driving gears 103, the position of another end of the reset spring 104 in the axial internal hole is limited by the face of the door of the safe, the circular skirt-like fringe at the internal edge of the dial 101 corresponds to the transmitter tube and receiver tube of the photoelectric switch 107 through two slot openings of the panel body 111.

The specific application of the input device of the dial-type electronic combination lock of the present embodiment will be described as follows.

The dial 101 is turned when it requires to open the lock, when the displayed two bits of number are the same as the first part of the preset unlocking combination, the turning will be stopped and the dial 101 will be depressed axially, at this time, the dot symbols distributed at the most lower part of the half circle on the information display screen 110 are illuminated, it indicates that the first part of the combination is confirmed and inputted, and the other parts of the combination is inputted according to the same method, during the procedure of confirming and inputting each part of the combination, the dot symbols distributed as a half circle on the information display screen 110 are illuminated in turn, after the last part of the combination is inputted, the entire combination is sent to the combination identification device of the combination lock by MCU 106, the received combination is identified and decided by the combination identification device, if the decided combination result is true, then the lock will be opened by an electromotive driving device under the control of the combination identification device, and an open lock signal will be sent to MCU 106, after the open lock signal is received by MCU 106, the symbol having the padlock shape on the information display screen 110 is illuminated under its control.

When it is required to re-set the unlocking combination, firstly, the set combination is inputted via the above said steps of inputting and confirming the combination, when the set combination inputted is decided as true, the symbol having the key shape is illuminated, it indicates that it enters the combination setting state, at this time, a new unlocking combination can be inputted.

When the voltage of the power supply of the combination lock measured by MCU 106 is lower than a prescribed value, the symbol having a battery shape is illuminated, prompting that it is required to change the battery.

Input Device of the Roller Type Electronic Combination Lock

Figure 7:
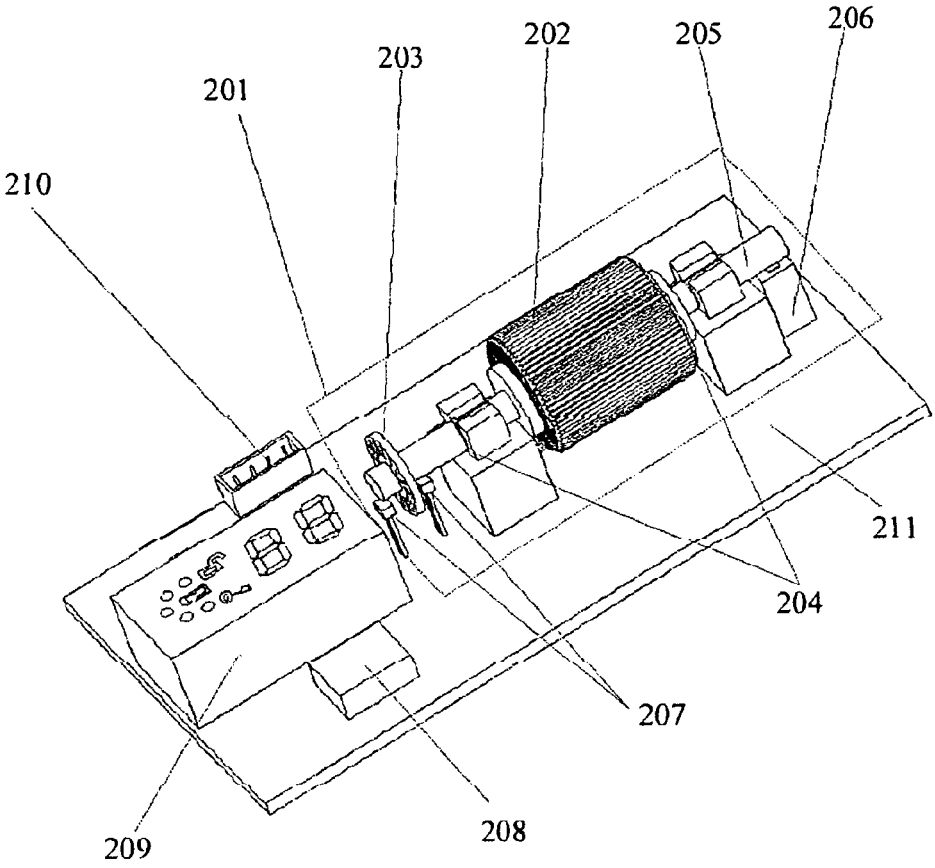
FIG. 7 is a schematic structure diagram according to a third embodiment of the invention.

The input device of the electronic combination lock of the invention can also be produced specifically as a roller form as required, just as shown in the third preferred embodiment of the invention. As shown in FIG. 7, when it is produced as an input device of a roller type electronic combination lock, a signal device 2 is a roller device 201 (a part inside the dash line block in FIG. 7), comprising: a roller 202, a coder 212 which is coaxial with the roller 202, and an elastic bracket 204 for supporting the roller 202; a measurement and control device 3 is a programmed microcontroller 208; a display device 4 is an information display screen 209, and a switch device 5 is a microswitch 206 provided below the shaft extension of the roller 202. The microcontroller 208 is connected electrically with the coder, the information display screen 209 and the microswitch 206 respectively.

A photoelectric coder can be used as the rotation coder, it is composed of a photoelectric wheel 203, and a light emitting diode and a phototriode 207 which are disposed at two sides of the photoelectric wheel.

The microcontroller 208 is composed of a single-chip microcomputer MCU, a memory RAM, and peripheral circuits. The control program are contained in MCU, several I/O ports of MCU are connected electrically with the roller device 201 and the information display screen 209 respectively, wherein another I/O port is connected electrically to the combination identification device of the combination lock for data communicating.

Furthermore, a connector can be provided on the circuit board 211 so that MCU may be connected with the combination identification device of the combination lock and the power supply via the connector 210.

Figure 8:
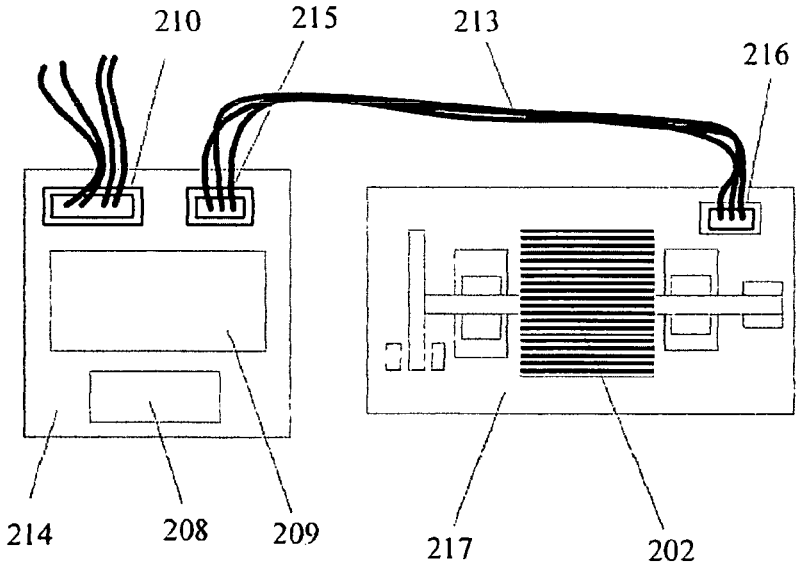
FIG. 8 shows another alternative structure form according to the third embodiment of the invention.

The roller device 201, microcontroller 208, information display screen 209, and microswitch 206 can be installed on the same circuit board 211, as shown in the drawing. And it may be also as shown in FIG. 8 that the information display screen 209 and microcontroller 208 are installed on one circuit board 214, and the roller device 201 and microswitch 206 are installed on another circuit board 217, to adapt to different installation conditions. The connector 210 can also be disposed on the circuit board 214 as shown in FIG. 7, and meanwhile, the connectors 215 and 216 can also be disposed on the circuit board 217, and the connectors 215 and 216 can be connected to each other via the wires 213. Those skilled in the art should understand that the technical results of these two installation forms are the same.

Returning back to FIG. 7, in the roller device 201, the rotation direction and the rotated angle of the roller 202 are converted into electrical pulse signals via the photoelectric wheel 203 and light emitting diode and a phototriode 207, said signals are directed into the I/O ports of MCU in the microcontroller 208, and after processing by MCU program, the information display screen 209 is controlled to display in a rolling manner the numbers 0-9. While the roller device 201 is depressed, the microswitch 206 disposed below its shaft extension 205 is actuated, then the electrical signals produced by the actuated microswitch 206 is directed to another I/O port of MCU as an input confirmation signal of the combination element, after deciding by the MCU program, the rolling display of information display screen 209 is stopped by the control of the microcontroller 208, and the current displayed number is confirmed as a part of the combination.

In the input device of the roller type electronic combination lock in the present embodiment, customized LED or LCD can be used as the information display screen 209. As shown in FIG. 7, the displayed contents displayed and the function are the same as those in the input device of the dial-type electronic combination lock in the second embodiment, only the bits of the displayed number and the order and the arrangement of the graphic symbols are different.

Figure 9:
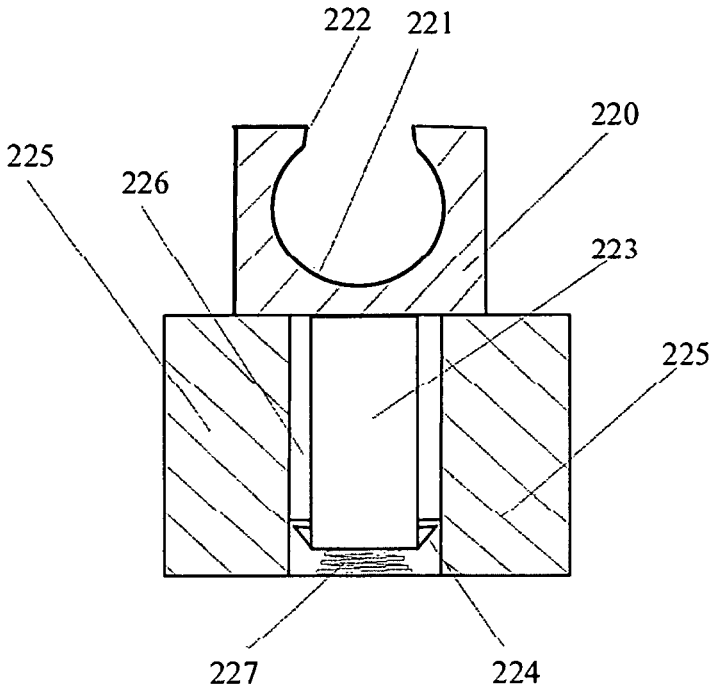
FIG. 9 shows an enlarged cross section structure of an elastic bracket in the third embodiment of the invention.
Figure 10:
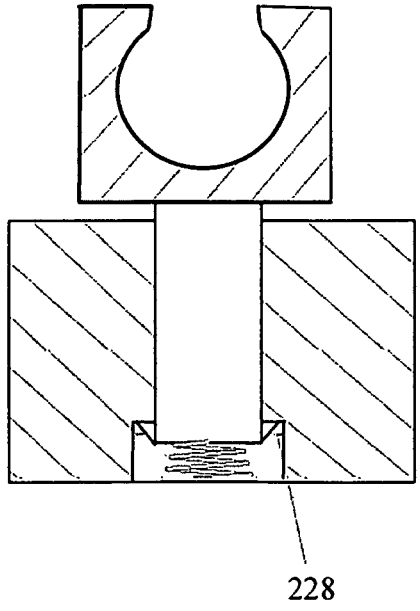
FIG. 10 shows an enlarged cross section structure of an elastic bracket at another state in the third embodiment of the invention.

FIG. 9 and FIG. 10 show the enlarged cross section diagram of the elastic bracket 204 under two states, respectively. The structures of these two elastic brackets 204 are substantially the same.

As shown in FIG. 9, the elastic bracket 204 is composed of a base 225, a reset spring 227, a Y-shaped bracket 220, wherein a circular shaft slot 221 matching with the shaft is provided on the top of the Y-shaped bracket 220, the size of an opening 222 of the shaft slot 221 is slightly smaller than the diameter of the shaft, when installing the shaft, the opening shall be spread slightly, after installing the shaft, the radial displacement is restricted by the opening, but it can rotate freely, shoulders provided on both ends of the roller 202 match the shaft slot 221 to restrict the axial displacement of the roller 202. The base 225 is fixed on the circuit board 211, and the reset spring 227 and the Y-shaped bracket 220 are installed inside the base 225, two snap hooks 224 are provided at the bottom of a cylindrical face where the Y-shaped bracket 220 matches with the base 225, two slide slots 226 for the Y-shaped bracket 220 and the snap hooks 224 to go through favorably and two snap slots 228 (in FIG. 10) arranged at an angle of 90 degrees with respect to the slide slots 226 are provided above a hole where the base 225 matches with the Y-shaped bracket 220.

As shown in FIG. 10, the Y-shaped bracket 220 and its snap hooks 224 are inserted into the hole in the base along the slide slot 226, when arriving the bottom, the Y-shaped bracket 220 is rotated by an angle of 90 degrees so that the snap hooks 224 and the snap slots 228 to be aligned, and under the action of the reset spring 227, the snap hooks 224 move upwardly and is snapped into the snap slots 228. In this way, the Y-shaped bracket 220 is fixed.

When the roller 202 is depressed, the Y-shaped bracket 220 moves downwardly by 1-2 mm along the snap slots 228, the shaft extension 205 at one end of the roller 202 actuates the microswitch 206 provided below it. When the depressing is released, the Y-shaped bracket 220 is reset by the reset spring 227.

Furthermore, if it is desired to produce the effect of a ratchet wheel during the rotation procedure of the roller 202, there are two schemes: the first one is that one end face of the roller 202 is fabricated in a corrugation shape, a spring having a ratchet wheel form (not shown) is installed on a base 225 near the corrugation end face of the roller 202, one end of said spring is fixed by the slot and hole on the base 225, and another end of the spring is bent to form a circle and contacts elastically with the corrugation end face of the roller 202, when the roller 202 rotates, it brings about a hand felling of a ratchet wheel. And the second one is that a blind hole (not shown in the drawing) is provided on the Y-shaped bracket 220 with a spring and a steel ball installed therein, and fabricating a segment of the surface of the roller shaft which fits with the Y-shaped bracket 220 as teeth form, the steel ball contacts and fits with said teeth under the function of the spring, and when the roller 202 rotates, it can also bring about a hand felling of a ratchet wheel.

Preferably, a buzzer can be installed on the circuit board 211, it may incorporate with the information display screen 209, a prompt information can be issued by them.

The use of the above roller type combination lock assembly will be explained as follows.

When it is desired to open the lock, the roller 202 is rotated, and the information display screen 209 displays the numbers 0-9 in a rolling manner as the rotation of the roller, the rolling order of the numbers (ascending order or descending order) corresponds to the rotation direction of the roller (clockwise or counterclockwise). When one bit of the currently displayed number and the first element of the preset unlocking combination are the same, the rotation is stopped and the roller 202 is depressed at a time. At this time, the first dot symbol on the information display screen 209 is illuminated, indicating that the first bit of the combination is confirmed and inputted. The other bits of the combination are inputted in the same manner, during the procedure for confirming each bit of the combination, the dot symbols are illuminated in turn on the information display screen 209.

After the last bit of the combination is inputted, if the inputted combination is completely true, then a symbol having a padlock shape will be illuminated, indicating that the lock has been opened.

If the inputted combination is wrong, then prompt information will be issued by the information display screen 209 and the buzzer (if installed), and the program proceeds to an error processing flow.

If it requires to enable the lock open function of the timing or delay timing, then the timing set state and delay timing set state can be entered by inputting special combination, said function can be enabled after inputting the time.

When it requires to re-set the unlocking combination, firstly, the set combination is entered by the above said steps for inputting the combination and confirming, when the inputted set combination is decided as true, the symbol having a key shape is illuminated, indicating that it enters the combination setting state, at this time, new unlocking combination can be inputted.

When the voltage of the power supply of the combination lock is lower than a prescribed value, a symbol having a battery shape is illuminated, prompting that the changing battery is needed.

The Handle of Combination Lock

When the above said input device of the roller type electronic combination lock is applied to a handle of the door lock, it constitutes a novel handle of the combination lock. The external structure of such handle of combination lock is shown in FIG. 11.

As shown in the drawing, the handle body 301 is hollow, and the above said input device of the roller type electronic combination lock is disposed inside the cavity. The input device of the roller type electronic combination lock assumes a form as shown in FIG. 7, a roller device 201, a microcontroller 208, a information display screen 209 and a microswitch 206 are installed on one circuit board 211, then the circuit board 211 can be fixed inside the cavity of the handle by screws. A first window 302, which corresponds to the roller 202 thereby the roller can be dialed and depressed conveniently, is provided on the front surface of the handle. Similarly, a second window 303, which corresponds to the information display screen 209 thereby the contents displayed by said information display screen 209 can be viewed conveniently and clearly, is further provided on the front surface of said handle.

In order to show the internal structure of the above said handle of the combination lock more clearly, FIG. 12 and FIG. 13 show a cross section of the handle of the combination lock shown in FIG. 11.

As shown in FIG. 12, the handle of the combination lock further comprises a rotation shaft 304 fixed within the handle body 301. It is known from FIG. 13 that a hole 305 for allowing the connection wires to pass through is provided inside the rotation shaft 304. The installed input device of the roller type electronic combination lock can be connected to a combination identification device and a power supply of the combination lock, which are installed inside the core mechanism of the lock or installed at other position inside the door, via the connector 210 and the wires 218.

An external structure of another handle of the combination lock is shown in FIG. 14. It is composed of a handle body 401, a panel 402 and a transparent window cover 403. A cross section structure of said handle of the combination lock is shown in FIG. 15. It is known from the drawing that a hollowed region 405, which has the size and shape that match with those of the panel 402 thereby the panel 402 being able to be embedded in, is provided on the handle body 401, the external surface of the panel 402 fits with the curved external surface of the handle body 401 smoothly. Common known snap structure can be used to fix the panel 402 on the handle body 401. It can also be seen form the drawing, the input device of the roller type electronic combination lock assumes the form as shown in FIG. 8, that is, it employs two circuit boards, wherein the microcontroller 208 and the information display screen 209 are installed on the circuit board 214, and the roller device 201 and the microswitch 206 are installed on the circuit board 217, and these two circuit boards are connected with each other via connectors 215 and 216 and wires 213. The circuit boards 214 and 217 are installed inside the panel 402, common known snap structure can be used to fix them, and the structure of using screws and nuts can also be used. A first window, which has the size and position that match the roller 202 thereby a part of the roller 202 is exposed and can be dialed and depressed conveniently by fingers, is provided on panel 402. Similarly, a second window, which has the size and position that match the information display screen 209 thereby the contents displayed on the information display screen 209 can be viewed clearly, is provided on the panel 402. A transparent window cover is snapped on the plane on which the second window is located at so that the displayed combination and information can be viewed while operating. The handle body 401 further comprises a rotation shaft 404 fixed therein, a hole, for allowing the connection wire 215 to pass through such that the input device of the roller type electronic combination lock may be connected with the combination identification device of the combination lock and a power supply, which are installed inside the door, is provided in the rotation shaft 404.

Yet another handle of the combination lock is shown in FIG. 16, it is composed of a handle body 501, a handle base 502 and a panel 504. It is known by referring to FIG. 15 in which its internal structure is shown, the input device of the roller type electronic combination lock employs the form as shown in FIG. 8, it is composed of two circuit boards, wherein the information display screen 209 and the microcontroller 208 are installed on a circuit board 214 which is fixed within the base 502, and the roller device 201 and the microswitch 206 are installed on a circuit board 217 which is fixed below the panel 502, and these two circuit boards are connected with each other via connectors 215 and 216 and wires 213. The base 502 is a housing having a cylindrical shape, a second window 505 used for viewing the contents displayed by the information display screen 209 is provided on its front face. A first window, which has the size and position that match with those of the roller 202 thereby a part of the roller 202 can be exposed so that it may be dialed and depressed by the fingers, is provided on the surface of the panel 504. The handle body 501 is hollow, and a cavity matching with the shape of said panel 504 is provided on the front surface of the handle body, and said panel is snapped on the internal edge of the cavity. A rotation shaft 506 is provided in the handle body 501, and holes 507 and 508 are provided in the rotation shaft 506 to allow the connection wires 218 to pass through the holes 507 and 508 thereby the input device of the roller type electronic combination lock is connected with the combination identification device and power supply of the combination lock installed inside the door.

The rotation shaft of the above said three types of the handles of the combination lock incorporates with the lock core mechanism or clutch device of the combination lock, and the lock core mechanism or clutch device is driven by a electromotive implementation mechanism of the combination lock, the electromotive implementation mechanism is controlled by the combination identification device of the combination lock, the combination identification device of the combination lock is connected electrically and communicates the data with the input device of the roller type electronic combination lock. Before the correct unlocking combination is inputted, the lock core mechanism or the clutch device are separated from the handle of the combination lock (is abbreviated to handle), at this time, the handle can not be rotated, and the lock bolt linked therewith is in a protruding state. After a correct unlocking combination is inputted according to the input method of the electronic combination lock of the invention, the electromotive implementation mechanism is operated by the control of the combination identification device, and the lock core mechanism or the clutch device is combined with the handle, at this time, the handle is turned downwardly for a angle, (not more than 90 degrees) so that the lock bolt is retracted into the lock body, and the lock is opened.

The Panel of the Combination Lock for the Chests and Bags

When the above said input device of the roller type electronic combination lock is applied to the lock for the chests and bags, it constitutes a novel panel of a combination lock for the chests and bags. FIG. 18 shows an external structure of such panel of a combination lock for the chests and bags applied to a chest body, the panel 603 of the combination lock for the chests and bags is fixed on the chest body 601, and the reference number 602 is a chest cover.

It can be known from FIG. 19 in which the internal structure is shown that the input device of the roller type electronic combination lock employs a form as shown in FIG. 7, the roller device 201, microcontroller 208, information display screen 209, and microswitch 206 are installed on the same circuit board 211, and the circuit board 211 is fixed within the panel 603 by using screws or a snapping structure. The panel 603 has a housing form, a second window 606, which has a rectangle shape and its shape and size matches with those of the information display screen 209, is provided on the panel. A transparent cover 607 is provided on said window 606 so that the user may view the displayed combination and information. A first window 605, the position and size of which match the roller 202 thereby a part of the roller 202 is exposed so that the roller may be dialed and depressed by the fingers, is also provided on the panel 603. The panel 603 can be fixed on the chest body by the rivets 604, and other fixing method that those skilled in the art are familiar with can also be used. The input device of the roller type electronic combination lock is connected with the combination identification device and the power supply which are installed within the chest by the wires 218. The electromotive implementation device and the mechanical lock mechanism of the chest and bag lock operate in a linkage manner, when a correct unlocking combination is inputted, the implementation device is driven by the control of the combination identification device, the lock mechanism is opened, thus the cover 602 of the chest can be opened.

Although the input device, input method and the application of the electronic combination lock of the invention have been described by referring to the above embodiments, however, those skilled in the art shall understand, it is apparent that the form and details thereof can be modified without departing the scope and the spirit of the invention. Therefore, the above described embodiments are only illustrative rather than restrictive, under a condition without departing the spirit and scope of the invention, all the changes and modifications are within the protection scope of the invention.

The invention claimed is:

1. An input device of an electronic combination lock, comprising:

a signal device for producing combination input information and for converting said information into two groups of electrical pulse signals;

a measurement and control device connected to said signal device for measuring the electrical pulse signals outputted from the signal device, deciding the order of the electrical pulse signals and calculating correspondingly such that said signals are converted into character sequences including combination elements, and deciding whether said current combination elements are confirmed to be inputted or not and deciding whether the input of all the combination elements is completed or not;

a confirmation device connected with said measurement and control device and used for producing a confirmation signal for inputting each single entry of a combination element to indicate that the input of the single entry is confirmed; and a display device connected with said measurement and control device for displaying, said character sequences and for displaying prefabricated prompt information in a rolling and refreshing manner by the driving of said measurement and control device, wherein said confirmation device is a switch device, an electrical signal produced when it is closed allows said measurement and control device to confirm the current combination element displayed by said display device as a part of a final input combination, said signal device consists essentially of:

a panel body, a rotatable dial installed on said panel body, a drive shaft located at a center of said dial, a set of driving gears installed on said drive shaft, a driven gear engaged with said driving gears, and an electromechanical rotating coder coupled with said driven gear on the drive shaft, a rotor of the coder having a mechanical driving relationship with the dial and rotating following the dial, the coder having two code signal output terminals, wherein when the dial rotates in a clockwise direction, an electrical pulse signal outputted from a first output terminal keeps ahead while when the dial rotates in a counterclockwise direction, an electrical pulse signal outputted from a second output terminal keeps ahead, the number of the pulses included in the two groups of electrical pulse signals being proportional to an angle through which the rotor of the coder has rotated, and frequencies of the pulse signals being proportional to a rotation rate of the rotor of the coder, wherein said measurement and control device is a programmed microcontroller;

wherein said display device is an information display screen, wherein said switch device is a photoelectric switch, wherein said programmed microcontroller, said coder, said information display screen and said photoelectric switch are provided on a same circuit board, said circuit hoard is provided within said panel body, and said microcontroller is connected electrically with said coder, said information display screen and said photoelectric switch, respectively, wherein the outer edge of said dial is a circular skirt-like fringe, the position of said photoelectric switch corresponds to the skirt-like fringe of said dial, when said dial is depressed, the light transmitted to the photoelectric switch is blocked by said skirt-like fringe, thereby a signal is produced by said photoelectric switch, and wherein the single combination entry is a single character or single digit entry.

2. The input device of the electronic combination lock as described in claim 1, wherein said measurement and control device is also used for deciding whether during a given timing period which starts each time when a signal is produced by said confirmation device, the timing period expires or not and if the timing period expires, then it decides that the input is during overtime.

3. The input device of the electronic combination lock as described ir claim 1, wherein the preset information displayed by said display device is indicated by symbols, wherein the close and open states of the lock are indicated by a symbol having a padlock shape, the time at which the lock is opened on time or is delayed to be opened is indicated by a symbol having a clock shape, the code setting state is indicated by a symbol having a key shape, and low power of battery is indicated by a symbol having a battery shape, and the confirmation states of the respective parts of the combination are indicated in turn by the remaining dot symbols.

4. The input device of the electronic combination lock as described in claim 1, wherein the outer edge of said dial is a circular skirt-like fringe, the position of said photoelectric switch corresponds to the skirt-like fringe of said dial, when said dial is depressed, the light transmitted to the photoelectric switch is blocked by said skirt-like fringe, thereby a signal is produced by said photoelectric switch.

5. The input device of the electronic combination lock as described in claim 1, wherein the upper part and lower part of said panel body are hunched to be ear-edge shaped, and said panel body further comprises:

grooves provided in back of said ear edge and matched with the fingers;

a display window, the shape and size of which matches with the shape and size of said information display screen, and which forms an oblique angle together with said information display screen for viewing effectively the displayed information; and a guiding hole provided at the display window side of said panel body for inserting an emergency key.

6. The input device of the electronic combination lock as described in claim 1, wherein it further comprises a reset spring installed within an internal axial hole provided on said drive shaft of said dial.

7. The input device of the electronic combination lock as described in claim 1, wherein a concentric circle plane gullet is provided on the internal end face of each of said set of driving gears, and a blind hole is provided on said plane gullet at a position corresponding to said panel body, and a steel ball and a spring are installed in said blind hole, said steel ball contacts and matches with the concentric circle plane gullet of said driving gear under the action of the spring.

8. An input device of an electronic combination lock, comprising:

a signal device for producing combination input information and for converting said information into two groups of electrical pulse signals;

a measurement and control device connected to said signal device for measuring the electrical pulse signals outputted from the signal device, deciding the order of the electrical pulse signals and calculating correspondingly such that said signals are converted into character sequences including the combination elements, and deciding, whether said current combination elements are confirmed to be inputted or not and deciding whether the input of all the combination elements is completed or not;

a confirmation device connected with said measurement and control device and used for producing a conformation signal for inputting a single entry of a combination element to indicate that the input of the single entry is confirmed; and a display device connected with said measurement and control device for displaying said character sequences and for displaying prefabricated prompt information in a rolling and refreshing manner by the driving of said measurement and control device, wherein said confirmation device is a switch device, an electric signal produced when it is closed allows said measurement and control device to confirm the current combination element displayed by said display device as a part of the input combination, wherein, the signal device is a roller device, the signal device consisting essentially of:

a roller;

a coder coaxial with the roller; and an elastic bracket for supporting said roller, wherein the roller consists essentially of:

a photoelectric wheel;

a light emitting diode; and a phototriode that are disposed at two sides of the photoelectric wheel, wherein a rotation direction and a rotated angle of the roller are converted into electrical pulse signals via the photoelectric wheel, the light emitting diode and the phototriode, wherein said measurement and control device is a programmed microcontroller, wherein said display device is an information display screen, wherein said switch device is a microswitch provided below the shaft extension of the roller, wherein said microcontroller is connected electrically with said coder, information display screen and microswitch respectively, and wherein the single combination entry is a single character or single digit entry.

9. The input device of the electronic combination lock as described in claim 8, wherein, said information display screen is used for displaying 1-bit or 2-bit number in a circularly rolling manner of an ascending order or descending order according to the direction and angle of the rotation of said roller;

said microswitch is used for that when the roller is depressed, the microswitch is actuated by the shah extension of said roller, thereby the rolling display of said information display screen is stopped, so that the number displayed currently is confirmed as a part of the combination; and said elastic bracket is used for resetting said roller after releasing the depressed roller.

10. A handle of a combination lock, wherein said handle is hollow and comprises:

an input device of the electronic combination lock as described in claim 8, which is fixed within a cavity of said handle;

a first window provided on the surface of said handle, the first window corresponds to said roller may be dialed and depressed;

a second window provided on the surface of the handle, the second window corresponds to said information display screen thereby the contents displayed may be viewed; and a rotation shaft fixed within the handle with a hole used for the wires to be passed through provided therein, wherein the input device of the electronic combination lock is connected with a combination identification device of the combination lock and a power supply which are installed inside the core mechanism of the lock or installed at other position inside the door via the wires.

11. A handle of a combination lock, wherein said handle is hollow and comprises:

a handle body comprises a rotation shaft fixed therein, and a hole provided inside said rotation shaft for allowing the connection wires to be passed through;

a panel, the input device of the electronic combination lock as described in claim 8 is installed inside the panel, a first window, which corresponds to said roller thereby said roller may be dialed and depressed, and a second window, which corresponds to said information display screen thereby the contents displayed may be viewed, are provided on said panel; and a transparent window cover provided on a plane on which there is said second window, wherein a hollowed region, which has the size and shape matching with that of said panel, is provided on the front surface of the handle body, thereby said panel can be embedded therein, and said handle of the combination lock is connected with a combination identification device and a power supply of the combination lock, which are installed, inside the core mechanism of the lock or installed at other positions inside the door, via the wires.

12. A handle of a combination lock, wherein it comprises;

a handle body;

a handle base with the microcontroller and information display screen of said input device of the electronic combination lock described in claim 8 installed therein, and a second window, which corresponds to said information display screen thereby the displayed contents may be viewed, is provided on the front face of the base; and a panel, a roller device of the input device of the electronic combination lock as described in claim 8 is installed inside the panel, a first window having the size and shape matching with that of the roller thereby said roller may be dialed and depressed is provided on the surface of said panel, wherein said handle is hollow, and a cavity matching with the size and shape of said panel is provided on the from surface of the handle, thereby said panel can be embedded therein, and said input device of the electronic combination lock is connected electrically with a combination identification device and a power supply of the combination lock which are installed inside the core mechanism of the lock or installed at other positions inside the door via the wires.

13. A panel of a combination lock for chests and bags, wherein the panel of the combination lock for the chests and bags is fixed on the external surface of the chest body, it comprises:

an input device of the electronic, combination lock as described in claim 8 installed within said panel;

a first window provided on the surface of said panel, which matches with the size and shape of said roller thereby said roller may be dialed and depressed; and a second window provided on said panel, which matches with the size and shape of said information display screen and having a transparent window cover provided thereon thereby the displayed contents may be viewed, wherein said input device of the combination lock is connected with a combination identification device and a power supply of the combination lock which are installed inside the chest body via the wires.

* * * * *